US005350530A

United States Patent [19]

Kim et al.

[11] Patent Number: 5,350,530

[45] Date of Patent: Sep. 27, 1994

[54] COAT-FINISHING METHOD FOR POLYESTER WOVEN AND KNITTED FABRICS

[75] Inventors: Ik S. Kim, Seoul; Do Y. Chung, Kyunggido; Jeong S. Kim, Kyunggido; Nam J. Kim, Kyunggido; Jae G. No, Kyunggido, all of Rep. of Korea

[73] Assignee: Sunkyong Industries, Kyungki-Do, Rep. of Korea

[21] Appl. No.: 65,901

[22] Filed: May 25, 1993

[30] Foreign Application Priority Data

Oct. 19, 1992 [KR] Rep. of Korea ..... 1992-19170

[51] Int. Cl.[5] ..... D06M 10/08

[52] U.S. Cl. ..... 252/8.6; 252/8.8; 252/608; 8/561; 8/563; 8/115.6; 106/215; 106/216; 106/217; 427/389.9; 427/393.3; 427/393.4

[58] Field of Search ..... 106/216, 217, 215, 163.1; 427/389.9, 393.3, 393.4; 252/8.6, 608, 8.8; 8/561, 563, 115.6

[56] References Cited

U.S. PATENT DOCUMENTS

| | | | |
|---|---|---|---|
| 2,503,622 | 4/1950 | Luaces | 106/215 |
| 2,503,623 | 4/1950 | Luaces | 106/215 |
| 4,339,239 | 7/1982 | Racciato | 8/561 |
| 4,985,155 | 1/1991 | Yamada et al. | 252/8.6 |
| 4,987,180 | 1/1991 | Ohata et al. | 524/860 |
| 5,154,966 | 10/1992 | Tohyama et al. | 428/241 |
| 5,157,090 | 10/1992 | Wilhelm et al. | 252/8.6 |
| 5,238,586 | 8/1993 | Uphues et al. | 252/8.6 |
| 5,246,611 | 9/1993 | Trinh | 252/8.6 |

FOREIGN PATENT DOCUMENTS

| | | |
|---|---|---|
| 60-39479 | 3/1985 | Japan . |
| 60-45680 | 3/1985 | Japan . |
| 61-19876 | 1/1986 | Japan . |
| 61-252383 | 11/1986 | Japan . |
| 1-207475 | 8/1989 | Japan . |
| 2-216262 | 8/1990 | Japan . |
| 3-45782 | 2/1991 | Japan . |

OTHER PUBLICATIONS

Japanese Industrial Standards JIS-L-0854 "Testing Method For Colour Fastness to Sublimation in Storage" (1975).

AATCC Test Method 163-1992 "Colorfastness: Dye Transfer in Storage; Fabric to Fabric", AATCC Technical Manual/1993.

*Primary Examiner*—Anthony Green

*Attorney, Agent, or Firm*—Birch, Stewart, Kolash & Birch

[57] ABSTRACT

A method is disclosed for coat-finishing dyed polyester woven and knitted fabrics wherein a maltooligosaccharide is added to the coating resin compounds.

9 Claims, No Drawings

COAT-FINISHING METHOD FOR POLYESTER WOVEN AND KNITTED FABRICS

BACKGROUND OF THE INVENTION

1. Field of the Invention

The present invention relates to a coat-finishing method for polyester woven and knitted fabrics which does not have migration problems.

2. Description of the Prior Art

Generally, nylon and cotton fibers and woven and knitted nylon and cotton fabrics, are base materials which are treated with coatings, such as, water proofing, moisture permeable water proofing, water-repellent and moisture permeable water proofing, flame-retardant and anti-melting, water-repellent and water proofing. Such coated fabrics are widely used as apparel and for industrial use.

Recently, a coat-finishing method for polyester woven and knitted fabrics has been developed because of the excellent mechanical properties, dimensional stability, weather resistance, aesthetical properties and low prices of polyester fiber.

However, these coat-finished, woven and knitted polyester fabrics suffer from problems. For example, the problem of staining white or light color fabrics adjacent to the coat-finished fabrics exists, due to the migration of the coating layer during the processes of coat-finishing, sewing, handling, storage and use.

Accordingly, the coat-finishing of polyester woven and knit fabrics is not performed on light color fabrics or is done with little regard to the migration problem.

Dyeing of polyester fiber by disperse dyes can be summarized as a process of inserting dye into the polymer chain by physical affinity, without chemical bonding between the fiber and the dyestuff.

Since the disperse dye migrates easily, especially to the coating layer, the quality of goods is lost and the migration from fiber to coating layer during sewing, handling, storage and use and from the coating layer to fiber goods adjacent to the coated fabrics occurs easily and results in staining.

To alleviate the above-mentioned migration problem of coat-finished fabrics composed of polyester fiber, a number of coating methods have been suggested to date.

Prior art solutions to the coating migration problem are summarized as follows.

Firstly, Japanese laid-open patent publication No. 61-252383 discloses preventing migration by using a special process of wetting with a tannin compound before or after the coat-finishing process.

Secondly, it is disclosed in Japanese laid-open patent publication No. 61-19876 that migration may be prevented by using N-alkoxydimethylated polyamide as a coating resin.

Thirdly, there is a method for formation of a special coating layer which prevents migration by coating a highly hydrophilic amino acid resin on an existing coating layer as shown in Japanese laid-open patent publication No. 60-39479.

Fourthly, performing the coat-finishing process after the dyed fabric is treated with a low temperature plasma at constant pressure is shown in Japanese laid-open patent publication No. 1-207475 and 3-45782.

In addition, a method for coating is disclosed wherein the resin composition has a powder such as aluminum, copper, silver or calcium titanate, as shown in Japanese laid-open patent publication NO. 60-458680. Finally, methods for pretreating with porous silicon dioxide, which can encapsulate the dyestuff, or introducing the resin mixed with silicon dioxide into the surface of polyester woven and knitted fabrics are disclosed in Japanese laid-open patent publication No. 2-216262.

However, the above mentioned processes suffer from a number of problems such as, (a) It is expensive to add new process steps to the coat-finishing process or to localize a kind of coating resin and to mix the resin with an inorganic materials.

(b) The quality of goods is lost by decreasing the drapability of coated fabrics.

(c) The degree of confidence in production is decreased since the process of anti-migration coating is complicated and great care must be taken in the mixing process of the resin and the coat-finishing process.

In Japanese laid-open patent publication No. 61-252383, the basic concept to obtain good anti-migration properties is by coupling dyestuffs with a tannin compound to slow down the mobility of the dyestuffs in coating layer. However, it is expensive to treat the fabric with synthetic tannin and tannic acid since a special wetting process is necessary and the productivity is lowered by adding this new process step.

Moreover, the wetting treatment with tannin compound suggested in the above disclosure is a known method which is generally used for the improvement of color-fastness to washing of fiber goods dyed with acid-dyes, reactive dyes and partial basic dyes. But this treatment is known to be not effective or only slightly so in the case of disperse dyes.

Japanese laid-open patent publication No. 61-19876 is a method of preventing migration by weakening the affinity between the dyestuffs and the coating resin by coating an N-alkoxydimethylpolyamide resin, in that the degree of substitution of alkoxydimethyl groups is 5–40 mole %, on polyester woven and knitted fabric. However, this coating resin is more expensive than the existing urethane or acrylic resin and has an undesirable feel in use.

Japanese laid-open patent publication No. 60-39479 is a method of preventing migration of the dyestuffs to the coating layer by forming a coating layer of hydrophilic amino acid resin having poor affinity for disperse dyes on both sides or one side of the fabric. The concept of this reference is similar to the above-mentioned Japanese laid-open patent publication No. 61-19876 and it is expensive to form the coating layer of the special resin having such anti-migration properties and the productivity is lowered by adding a special process step.

Japanese laid-open patent publication No. 60-45680 is a method to obtain an anti-migration property by coating with a non-uniform resin composition which is composed of 0.5–50 weight %, based on the weight of resin. This anti-migration property is due to the effect of the metal powder which is distributed in the coating layer.

However, in order to obtain an anti-migration property, it is necessary to obtain a uniform coating layer of micro-powder by using the non-uniform composition composed of micro-powder and resin, but it is impossible to form a uniform coating layer by this method and the unique texture of the fabrics is damaged.

In Japanese laid-open patent publication No. 2-216262, the anti-migration property is obtained by encapsulating the migratory disperse dyes with porous silicon dioxide, which is introduced into the coating layer or into the fabrics. But it is difficult to mix the organic resin with inorganic powder uniformly, as in the above-mentioned Japanese laid-open patent publication No. 60-45680. It is also difficult to obtain a uniform coating layer and the confidence in the product may be low, since as the content of silicon dioxide in the coating resin is increased, the rate of viscosity increase is rapid and the viscosity is greatly variable with time after the resin is mixed.

In Japanese laid-open patent publications No. 1-207475 and 3-45782, coating is carried out after the anti-migration property is imparted to the dyed polyester fabrics by the anti-migration polymerization film or surface modification by treatment with low temperature plasma. But, the cost of equipment for the low temperature plasma process is very high and the process is not practical due to the poor product confidence and to the addition of special process steps.

SUMMARY OF THE INVENTION

Accordingly, it is an object of the present invention to provide a method of coat-finishing polyester fabrics which is simple and results in improved anti-migration properties.

Another object of the present invention is to provide a new method of coat-finishing polyester fabrics which solves the deficiencies of the prior art, such as the addition of special process steps, limitations of the types of coating resins and non-uniform composition of the coating resin.

Other objects and further scope of application of this invention will be apparent from the description and claims which follow. However, it should be understood that the detailed descriptions and specific examples are only given by means of illustration, even though they indicate preferred embodiments of this invention, since diverse practical applications and modifications of the spirit and scope of the invention will be apparent to an expert in the field of fiber chemistry and other relative arts from this particular description.

DESCRIPTION OF THE PREFERRED EMBODIMENT

The present invention relates to a new method of coat-finishing polyester fabrics, specifically, to a new method of coat-finishing polyester fabrics to produce anti-migration properties.

This method is comprised of two steps as follows.

(1) A uniform resin composition is formed by adding a cyclic compound of a non-reductive, maltooligosaccharine, a cyclodextrin in which 6–8 units of glucose exists in $\alpha$-1,4 glucoside-bonded form, to the coating resin composition.

(2) This uniform resin composition is coated on the fabric surface by known methods.

In the present invention, polyester fabric means fabrics in which polyester is one component, such as polyester-nylon, polyester-cotton, polyester-rayon and polyester-acrylic blends, as well as 100% polyester fabrics. The coating effect is especially high in the case of 100% polyester fabrics dyed with disperse dyes.

Among the cyclic compounds of non-reductive maltooligosaccharide, cyclodextrin, in which the glucose unit is composed of 6–8, $\alpha$-1,4 glucoside bonds, has good solubility in polar and nonpolary solvents and is not changed chemically on heat-setting due to its high stability above 180° C. Moreover, since the above cyclodextrin has good compatibility with the coating resin, it does not limit the choice of the resin and it is possible to obtain a coating material having various properties.

And it is possible to obtain a sufficient anti-migration property with even a small amount, since the cyclodextrin is uniformly dispersed into the coating layer, due to the uniform resin composition.

Since the cyclodextrin in the coating layer has good affinity towards disperse dyes, which migrate in the course of coating processes or sewing, handling and using, the cyclodextrin fixes the disperse dyes, which prevents migration; thus staining of white or light color fibers which come into contact with the coating layer does not occur.

The amount of cyclodextrin to be used depends, in particular, on the content of the disperse dye existing in the polyester fabrics; generally a suitable amount is 1.0–15 weight % based on the weight of the fabrics, preferably 2.0–10 weight %.

When the amount of cyclodextrin is less than 1.0 weight %, the effect is not sufficient and if the amount of cyclodextrin is more than 15 weight %, it is not economical, since no further improvement in the anti-migration property is obtained.

Furthermore, cyclodextrin having repeating units of glucose of less than 5 or more than 9 is very expensive, and not economical in comparison to the preferred cyclodextrin.

Resins for coat-finishing are not particularly limited, but one or more resins selected from acrylic, urethane, silicone, fluorinated vinyl chloride, amide, cellulose, peptide and rubber resin can be used for clothes, generally urethane and acrylic resins are used.

As a process of coat-finishing, dry processes, wet processes, melt cooling processes and laminating processes can be used without limitation. A suitable process should be selected, depending on the resin used and the appearance characteristics of the coating layer.

The polyester coated fabrics according to the present invention have excellent mechanical properties, chemical resistance, feel, aesthetic properties and economical efficiency as compared to nylon and cotton fabrics. The coating compositions can be applied as coatings for clothes, such as moisture-permeable water proof and water-repellent and water proof materials and can be widely applied to industrial use.

The following examples will be given by way of illustration of the present invention but are not construed as limiting thereof.

The polyester fabrics which are used in examples and comparative examples are plain fabrics constituted of polyester 100d/192f as warp and polyester 75d/72f as weft, and having a warp of 216 ply/inch and a weft of 94 ply/inch.

Polyester fabrics were dyed with a disperse dye at 130° C. for 45 min., and washed by known methods, heat-set at 170° C. and coated.

Blue fabric was dyed with Dispersol Blue B-R (ICI, C.I. Disperse Blue 56) 5% o.w.f., red fabric was dyed with Dispersol Red B-2B (ICI, C.I. Disperse Red 60) 5% o.w.f., yellow fabric was dyed with Miketon Polyester Yellow F3G (Mitsui Doatsu Dyestuff Co., C.I. Disperse yellow 54) %5 o.w.f., and black fabric was dyed with Miketon Polyester Black PBSF (Mitsui Doatsu Dyestuff Co.) 10% o.w.f., respectively.

Migration of the coated fabrics was measured by Japanese Industrial Standard, JIS L 0854, wherein a white polyester fabric, coated with a conventional, non-cyclodextrin containing resin, was contacted with the dyed fabrics of the examples. The fabrics were inserted between two pieces of glass and pressed together with a 4.5 kg weight. The samples were kept in a constant temperature and moisture apparatus of 120° C.±2° C. for 80 min., and cooled to room temperature. The migration state from sample to the appended white fabrics was graded with a grey scale for staining.

The coating resin which was used in examples and comparative examples is as follows.

| | | |
|---|---|---|
| 1. | Polyester system polyurethane resin | |
| | CRISVON 8006HV: | Dainippon Ink and Chemical manufacture |
| | PARARESIN U-11: | Ohara Paragium Co. manufacture |
| 2. | Acrylic resin | |
| | CRISCOAT P-1018A: | Dainippon Ink and Chemical manufacture |
| 3. | Amino acid resin | |
| | LUCKSKIN UA-3295A, B: | Seiko Chemical Co. manufacture |

And the result of examples and comparative examples were shown in Table 1.

EXAMPLE 1

A uniform coating resin composition composed of CRISVON 8006HV urethane resin, 90 parts, DMF (demethylformamide), 50 parts, cyclodextrin having 7 repeating units of glucose, 10 parts and a crosslinking agent, 5 parts, was coated on test fabrics by gravure coating machine. The coated fabrics were coagulated in water, dried and heat-set, so that the adhesion amount of cyclodextrin in the fabrics was 5% o.w.f.

EXAMPLE 2

A uniform coating resin composed of CRISVON 8006HV urethane resin, 90 parts, DMF 50 parts, cyclodextrin having 5 repeating units of glucose, 15 parts and a crosslinking agent, 5 parts, was coated on test fabrics as in Example 1, so that the amount of cyclodextrin was 2.5% o.w.f.

EXAMPLE 3

A uniform coating resin composed of CRISVON 8006HV urethane resin 90 parts, DMF 50 parts, cyclodextrin having 8 repeating units of glucose, 15 parts and a crosslinking agent 5 parts was coated on test fabrics as in Example 1, so that the amount of cyclodextrin was 7.5% o.w.f.

COMPARATIVE EXAMPLE 1

A resin prepared by dissolving CRISVON 8006HV urethane resin, 100 parts, in DMF 30 parts was coated on test fabrics as in Example 1.

EXAMPLE 4

A uniform coating resin composed of CRISVON 8006 HV urethane resin, 90 parts, DMF 50 parts, cyclodextrin mixture having 6–8 repeating units of glucose, 20 parts and a crosslinking agent, 5 parts, was coated as in Example 1, so that the amount of cyclodextrin mixture was 7% o.w.f.

When CRISVON 8006 HV urethane resin was used in the above examples, CRISVON NX (Dainippon Ink and Chemical Co.) was used as crosslinking agent.

EXAMPLE 5

A uniform resin composition composed of cyclodextrin having 7 repeating units of glucose, 10 parts, DMF 30 parts, PARKRESIN U-11, 100 parts, Cat. U, which is the mixture of crosslinking agent and catalyst, 10 parts and ammonia water, as viscosity increasing agent, was knife coated on test fabrics. Coated fabrics were dried and heat-set, so that the amount of cyclodextrin was 3% o.w.f.

COMPARATIVE EXAMPLE 2

A uniform resin composition composed of PARARESIN U-11, 100 parts, Cat. U, 10 parts and ammonia water was coated on test fabrics as in Example 5.

EXAMPLE 6

A resin composition composed of CRISCOAT P-1018 A acrylic resin, 100 parts, CRISVON CL-3 (Dainippon Ink and Chemical Co.) as isocyanate system crosslinking agent, 3 parts, toluene, 2 parts and cyclodextrin having 7 repeating units of glucose, 10 parts, was knife coated on test fabrics. The coated fabrics were dried and heat-set, so that the amount of cyclodextrin was 8% o.w.f.

COMPARATIVE EXAMPLE 3

A resin composition composed of CRISCOAT P-1018 A acrylic resin, 100 parts, isocyanate system crosslinking agent, 3 parts, and toluene, 2 parts, was coated as in Example 6.

EXAMPLE 7

A uniform resin composition composed of LUCKSKIN 3295 A amino acid resin, 50 parts, LUCKSKIN 3295 B amino acid resin, 50 parts, LUCKSKIN CL-100 as crosslinking agent (Seiko Chemical Co.), 2 parts, DMF, 20 parts, cyclodextrin having 7 repeating units of glucose, 10 parts, was coated on test fabrics by gravure coating machine. The coated fabric was coagulated, washed, dried and heat-set, so that the amount of cyclodextrin was 4% o.w.f.

COMPARATIVE EXAMPLE 4

A resin composition composed of LUCKSKIN 3295 A amino acid resin, 50 parts, LUCKSKIN 3295 B amino acid resin, 50 parts, LUCKSKIN CL-100, 2 parts, DMF, 20 parts, was coated as in Example 7.

TABLE 1

| | Fastness to Sublimation (staining, grey scale) | | | |
|---|---|---|---|---|
| Section | Blue | Red | Yellow | Black |
| Example 1 | 4–5 | 4–5 | 5 | 4 |
| Example 2 | 4 | 4 | 4–5 | 3–4 |
| Example 3 | 4–5 | 4–5 | 4–5 | 4 |
| Example 4 | 5 | 5 | 5 | 4–5 |
| Example 5 | 5 | 4–5 | 5 | 4 |
| Example 6 | 5 | 5 | 5 | 4–5 |
| Example 7 | 4 | 4 | 4 | 4 |
| Comparative Example 1 | 2 | 1–2 | 2 | 1 |
| Comparative Example 2 | 2 | 2 | 2 | 1–2 |
| Comparative Example 3 | 2 | 2 | 2 | 1–2 |
| Comparative Example 4 | 2 | 2 | 2 | 1–2 |

What is claimed is:

1. A coat-finishing method for dyed polyester woven and knitted fabrics comprising the steps of (1) forming a uniform resin composition by adding a non-reductive, maltooligosaccharide to a coat-finishing resin composition comprising one or more resins selected from the group consisting of acrylic resins, urethane resins, silicone resins, fluorinated vinyl chloride resins, amide resins, cellulose resins, peptide resins and rubbers; and (2) coating a fabric surface with said uniform resin composition.

2. The coat-finishing method for polyester woven and knitted fabrics according to claim 1, wherein said non-reductive, maltooligosaccharide is a cyclodextrin compound containing 6 to 8 repeating units of glucose having α-1,4-glucoside bonding.

3. The coat-finishing method for polyester woven and knitted fabrics according to claim 1, wherein the amount of said non-reductive, maltooligosaccharide is 1.0 to 15 weight %, based on the weight of the woven and knitted fabrics.

4. The coat-finishing method according to claim 1, wherein said dyed polyester woven and knitted fabrics are 100% polyester fabrics and polyester blended fabrics.

5. The coat-finishing composition for dyed polyester woven and knitted fabrics comprising a coating resin and a non-reductive, maltooligosaccharide.

6. The coat-finishing composition of claim 5, wherein the non-reductive, maltooligosaccharide is a cyclodextrin compound containing 6 to 8 repeating units of glucose having α-1,4-glucoside bonding.

7. The coat-finishing composition according to claim 5, wherein said maltooligosaccharide is present at levels sufficient to provide a coating amount of from 1.0 to 15 weight %, based on the weight of the woven and knitted fabrics.

8. The coat-finishing composition according to claim 5, wherein said coating resin is one or more resins selected from the group consisting of acrylic resins, urethane resins, silicone resins, fluorinated vinyl chloride resins, amide resins, cellulose resins, peptide resins and rubbers.

9. The coat-finishing composition according to claim 5, further comprising a crosslinking agent and dimethylformamide.

* * * * *